US009115432B2

(12) United States Patent
Richardson et al.

(10) Patent No.: US 9,115,432 B2
(45) Date of Patent: Aug. 25, 2015

(54) METHODS AND COMPOSITIONS FOR INHIBITING METAL CORROSION IN HEATED AQUEOUS SOLUTIONS

(75) Inventors: John Richardson, Hanover, VA (US); Richard H. Tribble, Henrico, VA (US); Shauna R. Hopkins, Glen Allen, VA (US)

(73) Assignee: CHEMTREAT, INC., Glen Allen, VA (US)

( * ) Notice: Subject to any disclaimer, the term of this patent is extended or adjusted under 35 U.S.C. 154(b) by 0 days.

(21) Appl. No.: 13/466,117

(22) Filed: May 7, 2012

(65) Prior Publication Data

US 2012/0282136 A1 Nov. 8, 2012

Related U.S. Application Data

(60) Provisional application No. 61/483,346, filed on May 6, 2011.

(51) Int. Cl.
*C23F 11/18* (2006.01)

(52) U.S. Cl.
CPC ..... *C23F 11/18* (2013.01)

(58) Field of Classification Search
CPC ..... A23C 3/023; A23C 3/027; A23L 3/02; C23F 11/18
USPC ..... 422/7
See application file for complete search history.

(56) References Cited

U.S. PATENT DOCUMENTS

| | | | | |
|---|---|---|---|---|
| 3,622,357 | A * | 11/1971 | Tillman | 99/370 |
| 4,207,060 | A * | 6/1980 | Zangs | 432/77 |
| 4,255,457 | A * | 3/1981 | Collias | 426/407 |
| 4,721,532 | A * | 1/1988 | Kuhn et al. | 134/3 |
| 2001/0022947 | A1* | 9/2001 | Riggs, Jr. | 422/14 |
| 2001/0046543 | A1* | 11/2001 | Land | 426/521 |
| 2006/0118761 | A1* | 6/2006 | Stapp | 252/175 |

FOREIGN PATENT DOCUMENTS

| | | | | |
|---|---|---|---|---|
| JP | 03277790 | * | 12/1991 | C23F 11/12 |

OTHER PUBLICATIONS

English translation by FLS Inc. of JP 03277790 Akama et al. Dec. 1991.*

* cited by examiner

*Primary Examiner* — Sean E Conley
*Assistant Examiner* — Donald Spamer
(74) *Attorney, Agent, or Firm* — Oliff PLC

(57) ABSTRACT

Disclosed are methods for inhibiting corrosion of metals in contact with heated water or heated aqueous solutions during, for example, food and beverage packaging operations including, for example, cooking, pasteurization and/or sterilization through the use of one or more stannous salts and/or reducing agents.

17 Claims, 4 Drawing Sheets

METHODS AND COMPOSITIONS FOR INHIBITING METAL CORROSION IN HEATED AQUEOUS SOLUTIONS

The present invention relates to methods for inhibiting corrosion of metals in contact with heated water or heated aqueous solution(s) during, for example, food and beverage packaging operations including, for example, cooking, pasteurization and/or sterilization. This application claims priority from U.S. Prov. Pat. Appl. No. 61/483,346, filed May 6, 2011, the contents of which are incorporated by reference in their entirety.

FIELD OF THE INVENTION

Background of the Invention

In the food industry ferrous metals are used in the packaging, storage and distribution of food items and beverages in the containment and protection of the products. After packaging in metal cans, or glass or plastic bottles with metal lids, packaged food items must be cooked or pasteurized by contact with water. This is performed at elevated temperatures for a period of time necessary to eliminate bacterial contamination, in order to extend the shelf life of otherwise perishable items. Water temperatures utilized within the food industry for cooking/pasteurization and/or sterilization commonly exceed 140° F. for periods of time greater than ten minutes.

As will be appreciated by those skilled in the art, although the conditions under which the food containers are processed during the cooking/pasteurization and/or sterilization processes can be highly corrosive, noticeable corrosion on the finished product, even if purely cosmetic, is not acceptable to the vendors and general public and result in wastage and returns. Accordingly, a number of methods, techniques and materials have been utilized through the years in an effort to suppress corrosion during such processing.

Even when the susceptible metal is provided with a protective layer as provided on, for example, "tin" cans or bottle caps, regions of the metal may be exposed during the course of processing with such exposure being incidental/accidental, e.g., contact between cans, a function of the processing, e.g., crimping operations or deliberate, e.g., protective layer removed from a region for subsequent bonding. Regardless of the manner by which the metal is exposed, Traditional methods of the prevention of corrosion in caps, lids or cans involve controlling water chemistry and/or the addition of corrosion inhibitors or coatings. Traditional inhibitors incorporate the use of cathodic, anodic or filming inhibitors which, in turn, commonly include a combination of organic and inorganic phosphates, zinc, molybdate(s) and/or silicate(s), either singly or in combination.

Each of these traditional solutions, however, carries with it certain environmental concerns regarding environmental toxicity, associated with zinc and certain organic components, water quality issues, for example the nutrient effect with bacteria and algae associated with the discharge of phosphates and/or increasing cost as, for example, increasing demand in other industries for molybdate that reduces the supply and increases the cost. Many of these concerns can be addressed through water treatment or controlled disposal methods as necessary to meet applicable air, water and workplace regulations, but such compliance also increases costs and associated documentation and regulatory burdens.

SUMMARY OF THE INVENTION

The method disclosed provides comparable or even improved corrosion performance for exposed metal in aqueous environments operating in excess of 100° F. by utilizing ionic tin, present as a stannous salt, in the aqueous working solution. Although the stannous salt can be used in combination with other corrosion inhibitors, the stannous salt has been found capable of providing sufficient anti-corrosion activity without the need for other corrosion inhibitors. By avoiding or reducing the need for other anti-corrosion treatments, the present method also avoids or reduces the environmental, toxicity and regulatory concerns associated with such anti-corrosion treatments.

Unexpected advantages have been discovered in connection with the application of stannous corrosion inhibitors in hot water cookers according to the present method including, for example, improved corrosion inhibition performance, reduced fouling potential, improved environmental profile, improved halogen resistance, improved pH range tolerance and phosphate free discharge.

BRIEF DESCRIPTION OF THE DRAWINGS

In order to provide a more complete explanation of the water treatment methods and associated systems as disclosed and claimed herein, and the various embodiments thereof, attention is directed to the accompanying figures, wherein:

DETAILED DESCRIPTION

Figure 1A:
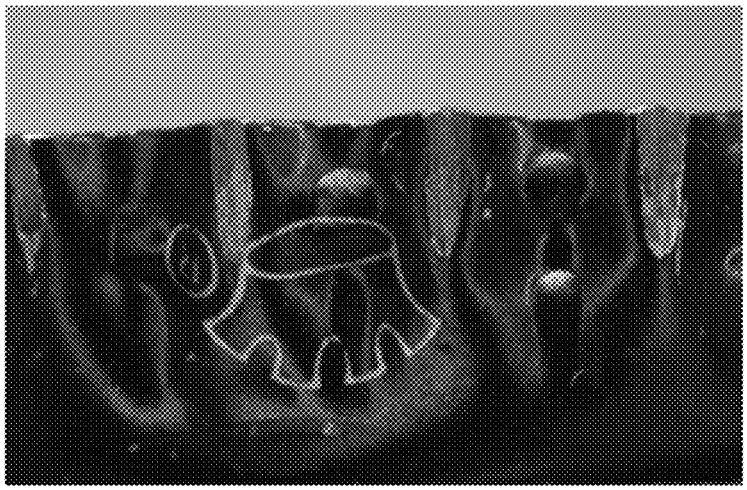
FIG. 1A illustrates a conventional bottle cap with surface damage before being subjected to a conventional pasteurization process using a process fluid that did not include a stannous compound according to the present invention.
Figure 1B:
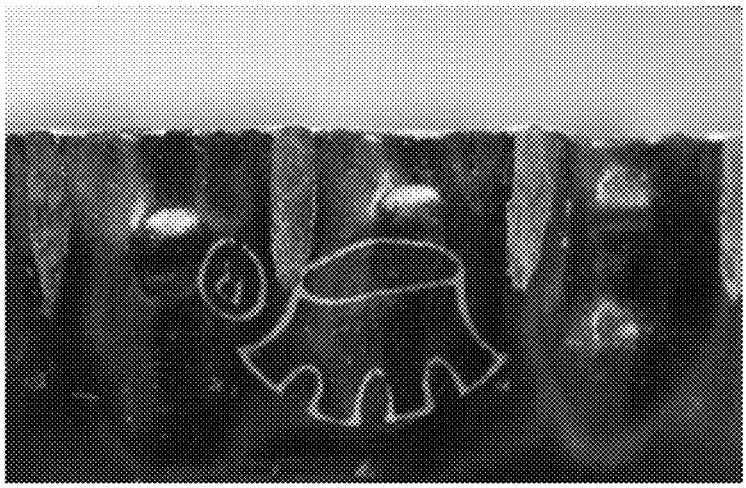
FIG. 1B illustrates the same bottle cap after exposure.
Figure 2A:
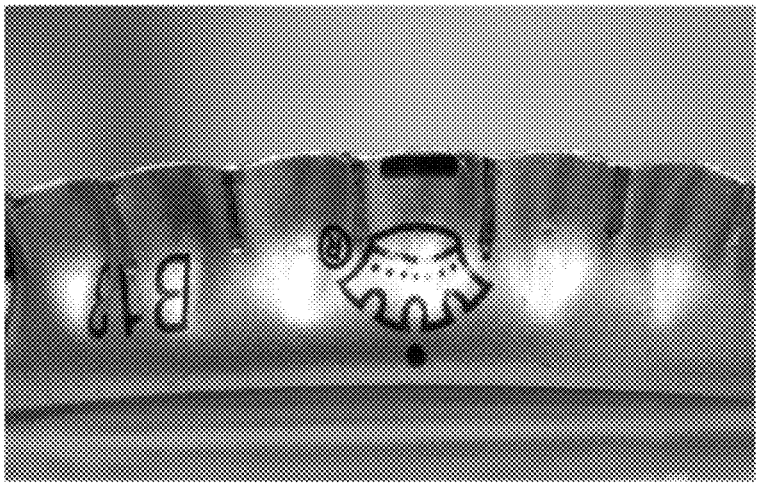
FIG. 2A illustrates another conventional bottle cap with surface damage before being subjected to a conventional pasteurization process using a process fluid that did not include a stannous compound according to the present invention.
Figure 2B:
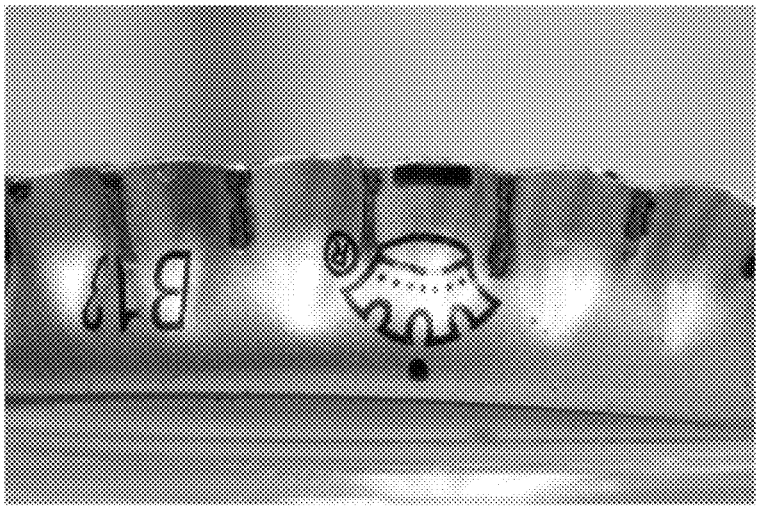
FIG. 2B illustrates the same bottle cap after exposure.
Figure 3A:
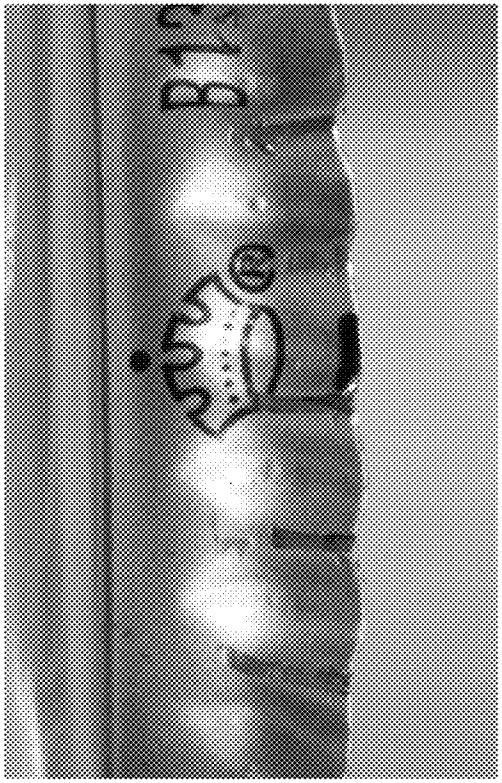
FIG. 3A illustrates a conventional bottle cap with surface damage before being subjected to a conventional pasteurization process using a process fluid that included a stannous compound according to the present invention, specifically 3 ppm stannous as $SnCl_2$.
Figure 3B:
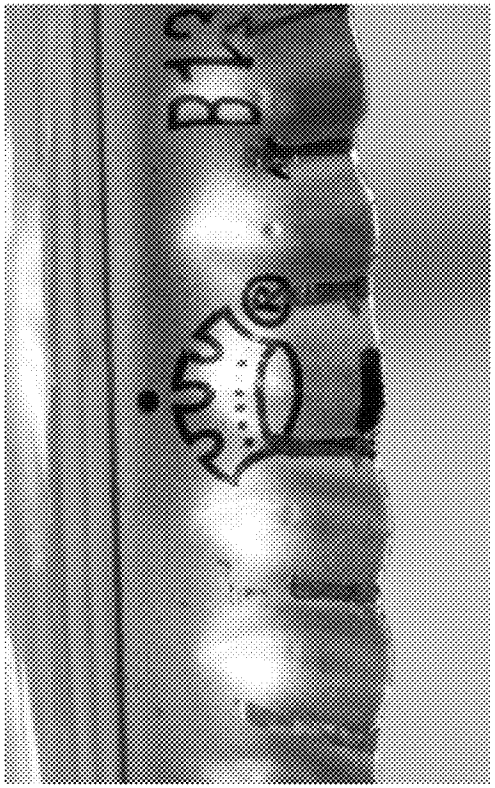
FIG. 3B illustrates the same bottle cap after exposure.
Figure 4:
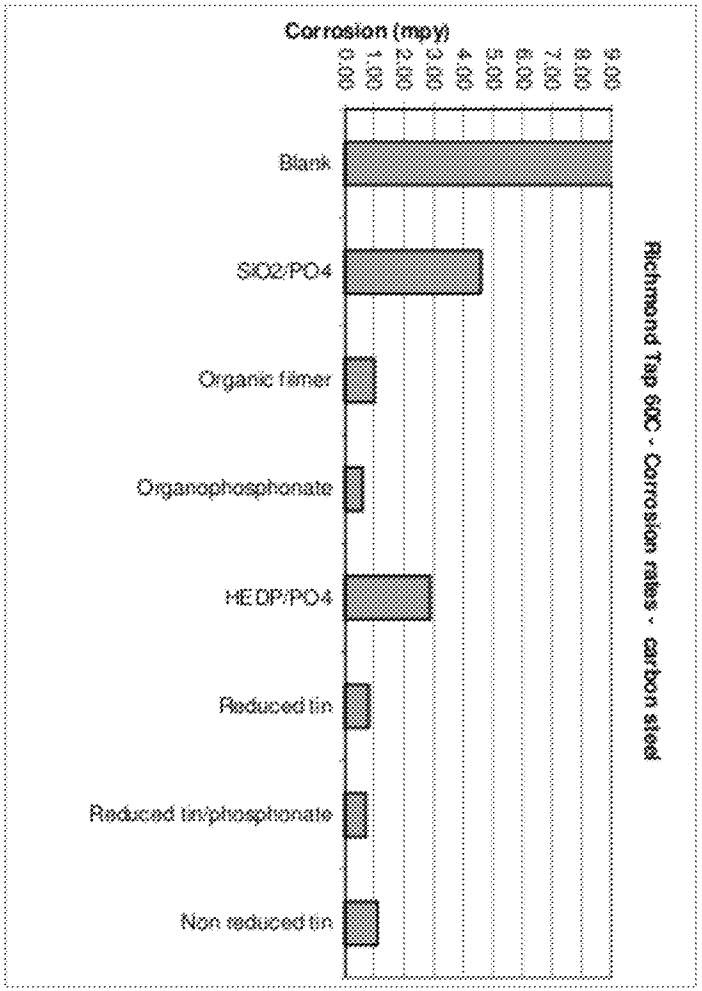
FIG. 4 illustrates the results of the coupon test using various solutions during a simulated pasteurization process at 60° C. for treating standard Richmond, Va. tap water.

The present method provides corrosion inhibition for exposed metal surfaces of packaged food items such as tin cans or bottle caps which occurs during, for example, cooking or sterilization of the products, through the application of stannous salt(s) at concentrations of 0.1 mg/L to 250 mg/L, either singly in conjunction with other corrosion inhibitors or additives. As will be appreciated, the particular concentrations and active species may be adapted to the particular products, processes, water chemistry and corrosivity of the water as necessary to obtain the desired degree of corrosion suppression.

Monitoring and control systems may be utilized for maintaining the stannous salt(s) concentration within the working fluid at a level of 0.05 mg/L to 100 mg/L as the products are being processed through the heated solution.

Metal surfaces exposed to heated aqueous solutions can be subject to high levels of corrosion due to various factors including, for example, the operating temperature, the metal alloy composition and the duration of the operation. In addition, the water used in preparing the working solutions in such systems can be of moderately high alkalinity (about pH 8-9)

and high hardness, having very high levels (e.g., in excess of 200 ppm) of dissolved metal cations such as calcium and magnesium.

As used herein, metal "corrosion" refers to degradation of the metal due to chemical reaction with its environment, in this case, water and substances present in the water.

As used herein, an anti-corrosion composition "consisting essentially of" a stannous salt refers to the stannous salt, or aqueous solution of such a salt, either singly or in combination with one or more optional components that do not materially affect the metal corrosion inhibiting characteristic(s) of the composition including, for example, various dispersing agents, chelating agents, surfactants and/or biocides.

As used herein, a "concentration of stannous salt which corresponds to a concentration of tin" in a given concentration range is determined from the relative molecular weights of the included salts. For example, a solution comprising 1.0 parts per million (ppm) tin will, in turn, correspond to approximately. 1.8 ppm $SnSO_4$, 1.6 ppm $SnCl_2$, or 2.3 ppm $SnBr_2$.

As used herein, "treatment" or "treating" refers to adding the concentrate to a subject body or volume of water to reduce corrosion of corrodible metals.

As used herein, a "concentrate" refers to a solution or suspension of active agent(s) that will be diluted in a body or volume of working fluid to achieve a predetermined final or target concentration of the active agents. Such solution concentrates are typically formulated to include the minimum amount of water necessary to maintain the active agents in solution under anticipated storage and use conditions to avoid or suppress precipitation of any of the included solutes. Similarly, such suspension concentrates are typically formulated to include the minimum amount of water necessary to maintain the active agents in suspension under anticipated storage and use conditions to avoid or suppress precipitation of any of the suspended agents whereby, upon dilution, the agents are solubilized.

As noted above, wetted bare metal surfaces can suffer high levels of corrosion due to variety of factors, including the composition, temperature and/or pH of the contact solution (s), to which the metals are exposed.

Preferred stannous salt concentrates are near saturation to maximize the benefit of the compositions and methods. However, stability and storage requirements may require that the stannous concentrate is safely below saturation to prevent precipitation. Adding a reducing agent such as DEHA, erythorbic acid, ascorbic acid or bisulfate in quantities ranging from 0.1% to 5% will tend to improve storage performance.

Depending on the corrosiveness of the water, the presence of one or more reducing agents tends to improve the performance of low level stannous inhibition performance with demonstrated efficacy at levels as low as 0.25 mg/L in a cooking application. As will be appreciated by those skilled in the art, various factors including, for example, the steel composition, the process fluids applied to the steel and the conditions under which the fluids are applied can all impact the overall corrosion rates. The present methods, however, are capable of achieving corrosion rates for mild steel of less than 2.0 mpy at concentrations as low as 0.25 to 2.0 mg/L although higher concentrations may be necessary in more challenging environments in order to achieve acceptable performance.

The concentrated stannous salt compositions applied in accord with the disclosed method, can be effective, at relatively low concentrations, for inhibiting corrosion of metals by heated aqueous solutions, as noted above, and do not precipitate on the surface. The compositions are particularly effective for inhibiting corrosion of ferrous metals, such as carbon steel, as well as other metals such as copper, lead, and brass. The stannous salt compositions applied in a manner according to the disclosure may also remove at least a portion of existing corrosion product from steel surfaces, as the stannous ion reduces $Fe^{+3}$ to $Fe^{+2}$. The mechanism of stannous corrosion inhibition involves electron transfer, or reduction of iron, the use of a reducing agent in the formulation enables less stannous to be applied for efficacy.

As any product is formulated an amount of oxygen is introduced during mixing and some amount of stannous becomes oxidized. Including the reducing agent/s can prevent the loss of stannous through incidental oxidation as well as extend the shelf life. It was seen that including the reducing agent also improves corrosion efficacy. Up to 30% less stannous salt can be applied to achieve a similar level of corrosion inhibition when formulated in a reducing environment.

A study was performed to simulate a pasteurizing environment at 60° C., using various common corrosion inhibitors. The use of 0.1% reducing agent with 1.0 mg/L of stannous salt, as tin, shows an improvement over 1.0 mg/L of stannous salt without reducing agents added to the formulation. The results are reflected below in Table 1.

Richmond tap water composition typically includes, for example, about 50 mg/L Calcium hardness, 15 mg/L magnesium hardness, 60 mg/L total alkalinity, 10 mg/L silica and a slightly alkaline pH of about 7.8. The most recent water quality information available under the provisions of the 1996 Safe Drinking Water Act may be found at www.richmondgov.com/dpu/documents/reportWaterQuality2011.pdf, and are incorporated herein by reference.

TABLE 1

| Treatment | CR mild steel |
|---|---|
| Blank | 63.10 |
| $SiO_2/PO_4$ | 4.60 |
| Organic filmer | 1.00 |
| Organophosphonate | 0.60 |
| HEDP/PO4 | 2.88 |
| Reduced tin | 0.80 |
| Reduced tin/phosphonate | 0.70 |
| Non reduced tin | 1.10 |

The reduced formulation improves the efficacy of the stannous compound(s) and its ability to inhibit corrosion in hot water systems. The applications may include 0.25 to 5 mg/L and higher of stannous in pasteurizer applications to alleviate corrosion on metal cans, lids and caps for glass or plastic bottles. The formulation may include 0.1% to 5% of a reducing agent as well as dispersant polymers which also help to stabilize stannous in solution. Applications may also include cooling for extremely hot systems such as steel smelting, copper and aluminum extrusions where carbon steel is used and is in contact with cooling water in excess of 40° C. and up to 105° C. where skin temperatures or the metal surface of such systems can exceed 100-200° C.

Pasteurizer and cooking applications may include a wide range of stannous concentrations of, for example, from 0.5 mg/L to 1500 mg/L depending on the turnover of the particular system(s) and the rate of water lost versus the rate at which product must be replaced.

In systems where the turnover is low and the holding time is high, the reducing agent(s) tend to maintain the efficacy of the stannous composition for extended periods of time. Typical holding time for a hot cooling system maybe up to three days and over ten days may be considered an extended holding time for an open system. Closed systems can operate indefinitely and, accordingly, tend to require higher concentrations of inhibitor, which can be maintained at a reasonable cost because of the lack of turnover in such systems. For extended periods stannous can be kept viable through use of the reducing agent, avoiding the higher cost of adding much more stannous to overcome incidental oxidation.

Another advantage of using stannous chloride as a corrosion inhibitor is that it does not add to solids loading. Stannous salts are very soluble and do not typically precipitate under normal operating conditions or conventional concentrations. Phosphate additives, in contrast, can result in precipitation when fed at levels to maintain concentrations of 15 mg/L or more into hot water systems having higher calcium concentrations of, for example, 200 mg/L or more.

Accordingly, stannous-based corrosion inhibitors according to the invention can fairly be considered to be "low maintenance" additives because over-feeding does not result in deposition or "can staining" resulting from salts present in a pasteurizer or cooker precipitate onto the surfaces of the cans undergoing sterilization.

Although only several exemplary embodiments of this invention have been described in detail, it will be readily apparent to those skilled in the art that the disclosed stannous compositions and associated water treatment processes may be modified from the exact embodiments provided herein without materially departing from the essential characteristics thereof. Accordingly, therefore, these disclosures are to be considered in all respects as illustrative and not restrictive. As will be appreciated by those skilled in the art, a number of other embodiments of the methods according to the disclosure are both feasible and would be expected to provide similar advantages. The scope of the invention, therefore, should be understood as encompassing those variations of the example embodiments detailed herein that would be readily apparent to one of ordinary skill in the art.

Further, while certain process steps are described for the purpose of enabling the reader to make and use certain water treatment processes shown, such suggestions shall not serve in any way to limit the claims to the exact variation disclosed, and it is to be understood that other variations, including various treatment additives or alkalinity removal techniques, may be utilized in practicing the disclosed methods.

We claim:

1. A method of suppressing metal corrosion in an open water system, the method comprising:

preparing a stannous concentrate including a tin compound and a reducing agent, wherein the reducing agent is present in an amount sufficient to maintain a reducing environment for the tin compound in the stannous concentrate;

modifying an aqueous working solution through addition of the stannous concentrate to sufficient to achieve a target concentration range of tin in a modified working solution;

applying the modified working solution to metal surfaces at a working temperature in excess of 35° C. in the open water system.

2. The method of suppressing metal corrosion according to claim 1, wherein:

the target concentration range of tin in the modified working solution is between 0.5 ppm and 10 ppm.

3. The method of suppressing metal corrosion according to claim 1, wherein:

the target concentration range of tin in the modified working solution is between 0.5 ppm and 5 ppm.

4. The method of suppressing metal corrosion according to claim 1, wherein:

the tin compound and the reducing agent are present in the stannous concentrate at a tin compound:reducing agent ratio of between 3:2 and 1:10.

5. The method of suppressing metal corrosion according to claim 1, wherein:

the target concentration range of tin in the modified working solution is between 0.1 ppm and 0.25 ppm.

6. The method of suppressing metal corrosion according to claim 1, wherein:

the target concentration range of tin in the modified working solution is no greater than 0.25 ppm.

7. The method of suppressing metal corrosion according to claim 1, wherein:

the reducing agent is selected from a group consisting of DEHA, erythorbic acid, ascorbic acid, sodium bisulfite and mixtures thereof.

8. The method of suppressing metal corrosion according to claim 7, wherein:

the reducing agent is present in the stannous concentrate at a concentration of from 0.1% to 5%.

9. The method of suppressing metal corrosion according to claim 1, wherein:

the stannous concentrate further comprises a dispersant polymer.

10. The method of suppressing metal corrosion according to claim 1, wherein:

the open water system is an open water cooling system.

11. A method of suppressing metal corrosion on exposed metal surfaces during thermal processing of packaged food items in an open water system, the method comprising:

preparing a stannous concentrate, the stannous concentrate including a tin compound and a reducing agent, the reducing agent being present in an amount sufficient to maintain a reducing environment for the tin compound in the stannous concentrate;

modifying an aqueous working solution through addition of the stannous concentrate to sufficient to achieve a target concentration range of tin in a modified working solution;

heating the modified working solution to a working temperature; and applying the heated modified working solution to the exposed surfaces of the packaged food item in the open water system.

12. The method of suppressing metal corrosion on exposed metal surfaces according to claim 11, wherein:

the open water system is an open water cooling system.

13. The method of suppressing metal corrosion on exposed metal surfaces according to claim 11, wherein:

the working temperature is at least 35° C.

14. The method of suppressing metal corrosion on exposed metal surfaces according to claim 13, wherein applying the heated modified working solution further comprises:

spraying the heated modified working solution onto the exposed surfaces of the packaged food item for a period sufficient to sterilize the exposed surfaces.

15. The method of suppressing metal corrosion on exposed metal surfaces according to claim 13, wherein applying the heated modified working solution further comprises:

spraying the heated modified working solution onto the exposed surfaces of the packaged food item for a period sufficient to pasteurize the packaged food item contents.

16. A method of suppressing metal corrosion on wetted metal surfaces in an open water cooling system, the method comprising:

preparing a stannous concentrate, the stannous concentrate including a tin compound, a reducing agent, the reducing agent being present in an amount sufficient to maintain a reducing environment for the tin compound in the stannous concentrate, and a polymeric dispersant;

modifying an aqueous working solution through addition of the stannous concentrate to sufficient to achieve a target concentration range of tin in a modified working solution; and applying the modified working solution to a heated metal surface in order to remove heat from the metal surface in the open water system.

17. The method of suppressing metal corrosion on wetted metal surfaces according to claim 16, wherein:

the heated metal surface exhibits a temperature of at least 100° C.

* * * * *